United States Patent [19]

Lipinski

[11] Patent Number: 4,733,604

[45] Date of Patent: Mar. 29, 1988

[54] AXIALLY SLIT PRESSURE CYLINDER WITH REINFORCED SEALING STRIP

[75] Inventor: Reinhard Lipinski, Plochingen, Fed. Rep. of Germany

[73] Assignee: PROMA Produkt-und- Marketing Gesellschaft mbH, Plochingen, Fed. Rep. of Germany

[21] Appl. No.: 13,451

[22] Filed: Feb. 11, 1987

[30] Foreign Application Priority Data

Sep. 17, 1986 [DE] Fed. Rep. of Germany ..... 3631514

[51] Int. Cl.[4] ..... F01B 29/00

[52] U.S. Cl. ..... 92/88

[58] Field of Search ..... 92/88; 244/63; 104/139, 104/140, 146, 155, 156, 161

[56] References Cited

U.S. PATENT DOCUMENTS

| | | | |
|---|---|---|---|
| 3,124,878 | 9/1982 | Kaiser | 92/88 |
| 4,373,427 | 2/1983 | Garlapaty et al. | 92/88 |
| 4,545,290 | 10/1985 | Lieberman | 92/88 |
| 4,555,980 | 12/1985 | Hoglund | 92/88 |

FOREIGN PATENT DOCUMENTS

| | | | |
|---|---|---|---|
| 0033541 | 8/1981 | European Pat. Off. . | |
| 0147803 | 7/1985 | European Pat. Off. . | |
| 3124878 | 12/1982 | Fed. Rep. of Germany . | |
| 3124915 | 1/1983 | Fed. Rep. of Germany . | |
| 8424035 | 10/1984 | Fed. Rep. of Germany . | |
| 3429783 | 2/1986 | Fed. Rep. of Germany . | |
| 2568955 | 2/1986 | France . | |
| 236370 | 8/1985 | German Democratic Rep. . | |
| WO83/02306 | 7/1983 | PCT Int'l Appl. . | |
| 470088 | 8/1937 | United Kingdom | 92/88 |

*Primary Examiner*—Robert E. Garrett
*Assistant Examiner*—Thomas E. Denion
*Attorney, Agent, or Firm*—Frishauf, Holtz, Goodman & Woodward

[57] ABSTRACT

In a pressure cylinder (1) having an elongated axially slit cylinder structure closed at the ends in which a piston (4) is guided longitudinally slideable which carries a force transfer element (6) extending through an elongated axial slit (5), the elongated axial slit (5) of the cylinder structure is sealed in the longitudinal direction of the cylinder by a flexible sealing strip (7) disposed on the inside of the cylinder structure and held against a sealing surface (10) of the inside of the cylinder structure. To adapt the pressure cylinder (1) to a higher inner pressure the arrangement is such that the elastically deformable sealing strip (7) has a stiffening strip (13) of greater strength which is connected with it and disposed in the inside of the cylinder structure and which is covered in the direction of the piston (4) by the sealing strip (7). On the cylinder structure on both sides of the elongated axial slit (7) and following the sealing surfaces (10) engagement surfaces (14) are disposed, against which the stiffening strip (14) can be supported.

24 Claims, 5 Drawing Figures

AXIALLY SLIT PRESSURE CYLINDER WITH REINFORCED SEALING STRIP

Reference to related patent, the disclosure of which is hereby incorporated by reference: U.S. Pat. No. 4,373,427.

Reference to related disclosure: U.S. Pat. No. 4,664,020, to which German Patent No. 31 24 878 corresponds.

The present invention relates to a pressure cylinder and more particularly to an axially slit pressure cylinder for use on a longitudinal motion or power transfer element which is coupled to a longitudinally slidable piston which has a projecting power transfer element, extending through the slit. Structures of this kind require a sealing element to seal the slit in the regions between the ends of the cylinder and the faces of the piston while permitting the piston to travel longitudinally, with the sealing strip passing through suitable openings in the power transfer element.

BACKGROUND

Various types of longitudinally, or axially slit pressure cylinders have been proposed. The sealing strip may be a flexible tape or ribbon which engages a sealing surface formed in the inner wall of the cylinder. At the outer wall of the cylinder, the sealing strip is carried over and/or through an opening in the power transfer element—which may be generally U-shaped. In one form, and to stiffen the cylinder, the flexible sealing strip, which is lifted off the sealing surface in regions opposite the piston is covered by a flexible cover strip or tape. Releasable connection elements are provided, retaining the cover strip or tape to the sealing strip which are released to permit separation as the piston travels in the separating direction, and to be reattached behind the piston to form a sealing and cover strip.

In a pressure cylinder with these characteristics, known from U.S. Pat. No. 4,664,020, to which German Patent No. 31 24 878 corresponds, the sealing strip and the cover strip are respectively formed as flexible plastic profiled strips, the connecting parts of which consist of a longitudinal ridge formed on one of the strips and of a longitudinal slit developed in the other strip which is arranged to receive the ridge. Although this results in a perfect sealing of the elongated axial slit on both sides of the force transfer element, the maximum amount of the pressure of the pressure means with which the interior of the cylinder structure can be charged is limited. This is because, when a certain maximum pressure is exceeded, there is a danger of the flexible plastic sealing strip being pressed into the axial slit by the pressure means while undergoing plastic deformation and thus losing its sealing ability. For this reason, the known cylinder can only be used in a lower pressure region such as is typical for a pneumatic cylinder.

A similar pressure cylinder with axially slit cylinder is known from U.S. Pat. No. 4,373,427, where the elongated axial slit is also sealingly closed by a sealing strip extending on the inside of the cylinder structure and a cover strip disposed on the exterior of the cylinder structure on both sides of the force transfer element. Both the sealing strip and the cover strip are two-layered; a plastic or rubber strip made of elastically deformable material and having a greater thickness is deposited on a thin ferritic steel strip. Both the sealing strip as well as the cover strip have a generally trapezoidal cross section, while correspondingly inclined surfaces are provided as sealing surfaces in the wall of the cylinder structure on both sides of the elongated axial slit, with which the elastomeric material layer of the respective strip cooperates sealingly. Especially in order to hold the sealing strip in the elongated axial slit, permanent magnets are disposed in the area of the edges of the elongated axial slit in the cylinder structure, the magnetic force lines of which can close via the ferritic steel strip of the sealing as well as the cover strip and thereby exert a magnetic drawing force on these strips.

Since the flat even steel strip on the side of the sealing strip oriented towards the piston is openly disposed, flat regions must be provided on the piston and on the piston seal gaskets, otherwise cylindrical in cross section, in the area opposite the sealing strip, which are undesirable and can lead to sealing problems in the piston sealing gaskets. Furthermore, the sealing effect obtainable from the elastomeric layer of the two-layered sealing strip is limited because the inner metal strip rests on the inclined sealing surfaces and thereby prevents the further pressing of the elastomeric parts on the sealing surfaces. To prevent this, the cylinder structure must be manufactured to relatively close tolerances in the area of its sealing surfaces and in the dimensions of its elongated axial slit, which is expensive and requires added effort.

THE INVENTION

It is an object to improve the sealing arrangement for a longitudinal slit pressure cylinder, in which the seal can accept higher pressures than heretofore possible, without placing extreme requirements on manufacturing tolerances of the sealing surfaces as well as on the sealing strip or tape and the cover strip or tape, particularly in the region of the longitudinal slit. Maintaining tight tolerances increases the cost of the structure.

Briefly, a stiffening strip means is provided, located in the interior of the cylinder and joined to the flexible sealing strip. The stiffening strip means has a higher strength and stiffness than the flexible sealing strip. Engagement surfaces between the sealing strip and the interior wall are located close to the sealing surfaces and positioned adjacent the sides of the slit, and form abutment and support surfaces for the stiffening strip means, the engagement surfaces preferably, defining recesses extending, radially outwardly, into which the stiffening means extend.

The stiffening strip means may be formed as inserts in the sealing strip or during manufacture of the sealing strip, by providing the sealing strip with a zone of increased stiffness and strength, for example of increased density with respect to the material which defines the sealing strip or sealing portion. Thus, a single strip can be used with—in cross section—different stiffness—flexibility and mechanical strength—deformability characteristics; or a separate insert element may be placed within a sealing strip.

Because the stiffening strip is separated from the piston by the flexible sealing strip or sections thereof, the flattened areas or similar measures at the piston or the piston gaskets are not required, since the flexible sealing strip can retain, on the side oriented towards the piston, its curvature which conforms to the cylindrical inner wall of the cylinder structure. The stiffening strip prevents, even at high pressures, an undesirable pressing of the sealing strip into the elongated axial slit. Therefore the pressure cylinder can sustain comparatively high pressures up to approximately 60 bar and above, such as are for example usual in low pressure hydraulic technology. Also, the sealing surfaces and the engagement surfaces are spatially separated from each other with the result that the sealing effect of the sealing strip is not diminished by the stiffening strip in the region of the sealing surfaces. Furthermore, the sealing as well as the cover strip can have low structural height, i.e. they can be flat, so that a simple profile assures a cost-efficient manufacture. Because of the above mentioned separation of the sealing and engagement surfaces comperatively large manufacturing variations can be tolerated without fear of an impairment of the sealing function.

The stiffening strip bridges the two engagement surfaces across a width which is greater than or the same as the width of the elongated axial slit. This prevents an arching into the elongated axial slit of the sealing strip together with the stiffening strip under the influence of the pressure means during very high pressure, which might lead to lifting of the flexible sealing strip from the sealing surfaces and therefore to the impairment of the sealing effect.

DRAWINGS

Exemplary embodiments of the invention are shown in the drawings.

FIG. 1 shows a pressure cylinder according to the invention in axial section, in a side view and in a schematic view, FIG. 2 shows the cylinder structure of the pressure cylinder in accordance with FIG. 1 in cross section along the line II—II of FIG. 1 in a perspective view, in a cut view and on a different scale, FIG. 3 shows the cylinder structure structure of the pressure cylinder in accordance with FIG. 1 in a view according to FIG. 2, depicting a second embodiment of the sealing and cover strips, and FIGS. 4 and 5 show the cylinder structure of the pressure cylinder in accordance with FIG. 1 in a view according to FIG. 2 respectively, depicting two further modifications of the sealing and cover strips.

DETAILED DESCRIPTION

Figure 1:
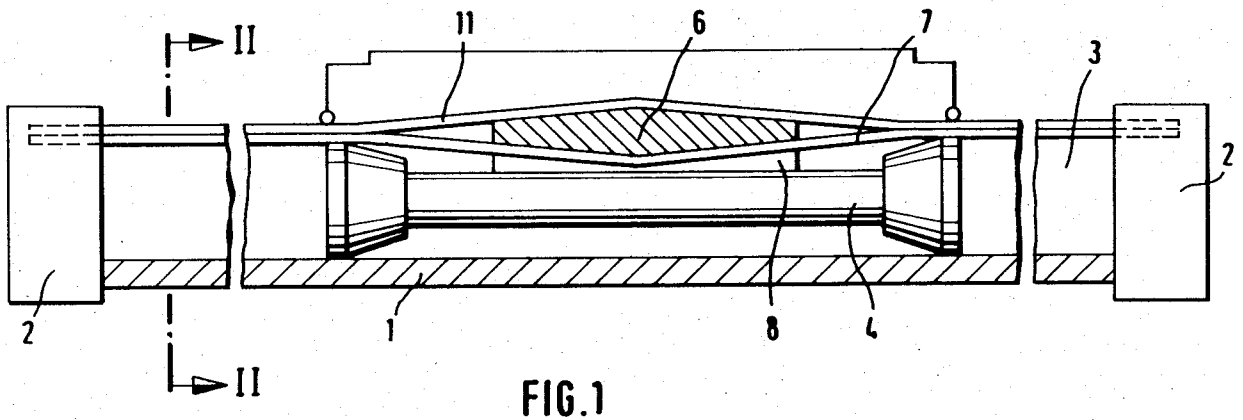

The pressure cylinder, shown schematically in FIG. 1, which can be used as pneumatic or low pressure hydraulic cylinder depending on its use, has a cylinder structure 1 of, for example, aluminum, sealingly closed on both ends by fitted end flanges 2, in the cylindrical inner chamber of which a cylindrical piston 4 is longitudinally slidable. As can be seen from FIG. 2, for example, the cylinder structure 1 has an elongated axial slit 5 extending over its length, through which extends outwardly a ridge-like force transfer element 6 rigidly fixed to the piston 4 which is equipped for connection with a machine element driven by it and not further shown. In the axial direction of the cylinder structure the elongated axial slit 5 is sealed on either side by a flexible sealing strip 7 disposed in the inner chamber 3 of the cylinder structure, which is anchored at both ends in the end flanges 2. The sealing strip 7 extends under the force transfer element 6 through a corresponding opening 8 in the region of the piston and is pressingly secured on both sides of the piston 4 with tip-stretched sealing lips 9 to the sealing surfaces 10. The sealing surfaces 10 are disposed on both sides of the elongated axial slit 5; they are generally flat and form an angle of approximately 120° with each other.

On the outside of the cylinder structure there is disposed a cover strip 11, likewise flexible, for the elongated axial slit 5 which is anchored with both of its ends in the end flanges 2 and is guided in the region of the force transfer element 6 over its top or through it. The cover strip 11 is made from a suitable plastic similar to the sealing strip 7.

The sealing strip 7 is, with its sealing lips 9, sealingly pressed against the sealing surfaces 10 by the cover strip 11 by means of releasable connecting elements cooperating through the elongated axial slit 5 and extending across the length of the strip. These connecting elements, to be further described in their varying embodiments by means of FIGS. 2 to 5, are basically constructed such that, in dependence from the axial movement of the piston 4, they can be separated from each other respectively in front of that side of the piston oriented towards the decreasing cylinder chamber and can be recombined respectively on the other side, as for example described in detail in German Patent No. 32 24 878.

The sealing strip 7 has, in the varying embodiments shown in FIGS. 2 to 5, a flat, thin stiffening strip 13 of greater strength and of generally rectangular cross section extending over the entire length of the sealing strip. The stiffening strip 13 is connected to the comparatively soft, flexibly deformable plastic or rubber material of the sealing strip 7 by, for example, gluing or vulcanizing, however, embodiments are also conceivable (FIG. 2) where it is simply entirely or partially surrounded by the material of the sealing strip 7 without the presence of particular connecting means between the two strips. It is further conceivable that the stiffening strip 13 forms an integral part of the sealing strip 7 such that, for example, the shaded region representing the sealing strip 7 in the cross sectional views according to FIGS. 2 to 7 represents a zone of higher strength and lesser deformability corresponding to the stiffening strip 13.

Figure 2:
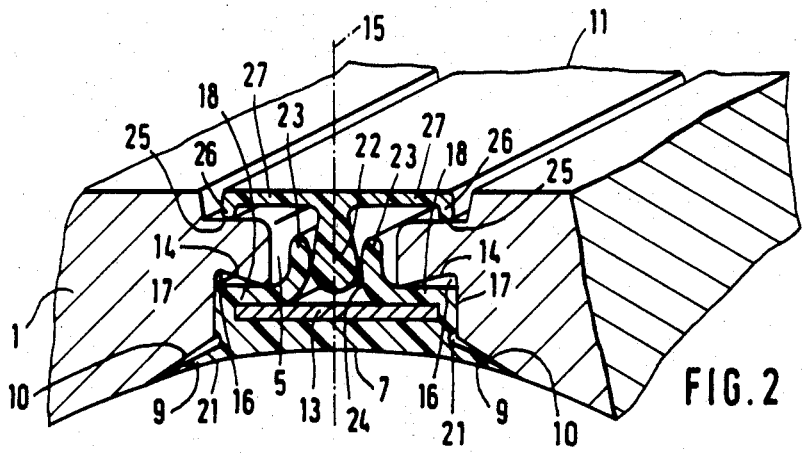
Figure 3:
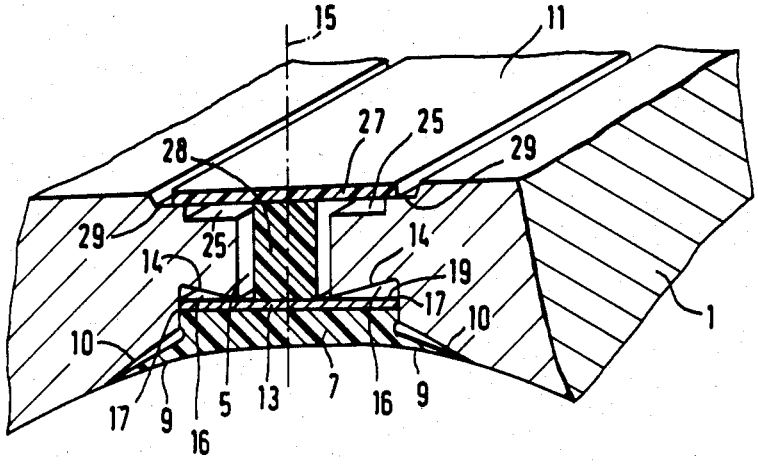

The thin stiffening strip or zone 13 which in the embodiment according to FIG. 2 consists alternately of a plastic material or of steel, is disposed in all embodiments on that side of the sealing strip 7 away from the piston 4, so that it is covered in the direction of the piston 4 by sealing strip 7, which in this region is curved corresponding to the cylindrical inner wall of the cylinder structure 1. Engagement surfaces 14 are disposed on both sides of the elongated axial slit 5 which either extend at right angles to the central plane 15 of the elongated axial slit 5 including the axis of the cylinder structure (FIGS. 4, 5) or which form an acute angle with this central plane 15 (FIGS. 2, 3). In the latter case there result inner relief recesses at 16, starting from the elongated axial slit 5, the meaning of which will be discussed in detail later. Parallel guide surfaces 17 generally extend between the engagement surfaces 14 and the sealing surfaces 10, assuring a lateral guidance of the sealing strip 7 in relation to the elongated axial slit 5 and simultaneously permit a radial mobility of the sealing strip 7—and, with it, of the stiffening strip 13—which is limited outwardly by the fact that the stiffening strip 13 rests on the engagement surfaces 14.

As shown in FIGS. 2 to 5, the stiffening strip 13 is in every case wide enough to bridge the engagement surfaces 14 on both sides of the elongated axial slit 5. The stiffening strip 13 can either, in the manner shown in FIGS. 2, 4 and 5, be embedded over at least part of its width in the sealing strip 7 or, as shown in FIG. 3, be fastened on top of the sealing strip 7, so that it rests against the engagement surfaces 14 either by means of the intervening parts 18 of the sealing strip 7 or directly by means of its generally flat, exposed upper surface 19 (FIG. 3), which extends at least approximately at right angles to the central plane 15.

Therefore the stiffening strip 13 crosses the elongated axial slit 5 and supports, by resting on the engagement surfaces 14, the sealing strip 7 in the region of the elongated axial slit 5 so that even with high pressure of the pressure means prevailing in the inner chamber 3 of the cylinder structure the sealing strip 7, easily deformable in regard to its sealing function, cannot be pressed into the elongated axial slit 5. In order to prevent a noticeable bulging of the thin stiffening strip 13—and with it the sealing strip 7—into the elongated axial slit 5 under the influence of high pressure, the arrangement according to the embodiment of FIG. 3 is such that the stiffening strip 13 extends across the engagement surfaces 14 by a width greater than the width of the elongated axial slit 5. The pressure acting across the width of the engagement surfaces 14 tries to press the corresponding regions of the stiffening strip 13 which are freely movable because of the inner relief recesses 16, related to FIG. 3, upwardly and this counteracts the also upwardly directed deformation of the stiffening strip 13 occurring in the region of the elongated axial slit 5. Based on the extent of the width of the stiffening strip 13 selected, it becomes possible that the stiffening strip remains generally flat in the region of the axial slit 5 or is even a little convexly arched in the direction of the inner chamber 3 of the cylinder structure. As best seen in FIGS. 2 and 3, the recesses 16 extend within the cylinder structure in a direction away from a central axis thereof, so that the engagement surfaces 14 flare upwardly and outwardly, that is, away from the central axis of the cylinder structure.

Since the radial support of the sealing strip 7 via the stiffening strip 13 takes place in all cases by means of the engagement surfaces 14 which are independent of the sealing surfaces 10, the sealing effect of the sealing lips 9, movably integrally connected via hinge regions 21 to the sealing strip 7 proper is not affected.

The connecting elements between the sealing strip and the cover strip 11 are formed, in the embodiment according to FIG. 2, by a ridge 22, tip-stretched symmetrically to the central plane, extending axially and profiled in cross section, cooperating with axially extending flanges 23 provided on the sealing strip 7. The two flanges 23 are disposed at a distance from each other and obviously delimit an axial groove 24 which engages the ridge 22. Moreover, they are formed by the edge regions, bent up or arched upwardly in the direction towards the elongated axial slit 5, of the sealing strip parts 18, which partially extend beyond the stiffening strip 13, between which there is an exposed central region at the bottom of the groove 24. During the lifting of the sealing strip 7 and the cover strip 11 from the cylinder structure 1 on one side of the piston, the ridge 22 is simply pulled out of the axial groove 24 and is then returned again to the axial groove on the other side of the piston when the two strips 7, 11 are reunited, where it is flexibly clamped by the two flanges 23 which are pre-stressed in an inward direction.

A slit 25 is formed on the outside of the cylinder structure on both sides of the elongated axial slit 5 which receives the cover strip 11. The arrangement is such that, at the bottom of the slits 25 at a lateral distance from the edges of the axial slit 5, the cover strip 11 is supported by support beads 26 which can also be divided in an axial direction, forming discrete support elements. Unsupported regions 27 of the cover strip 11 are thus created between the support beads 26 and the ridge 22 which permit an unrestricted, radially inwardly directed resilient springing of the cover strip 11, making it possible, regardless of manufacturing variations in the thickness of the outer wall of the cylinder structure 1 or the depths of the slits 25 etc., to always assure a perfect seating of the sealing strip 7.

Figure 4:
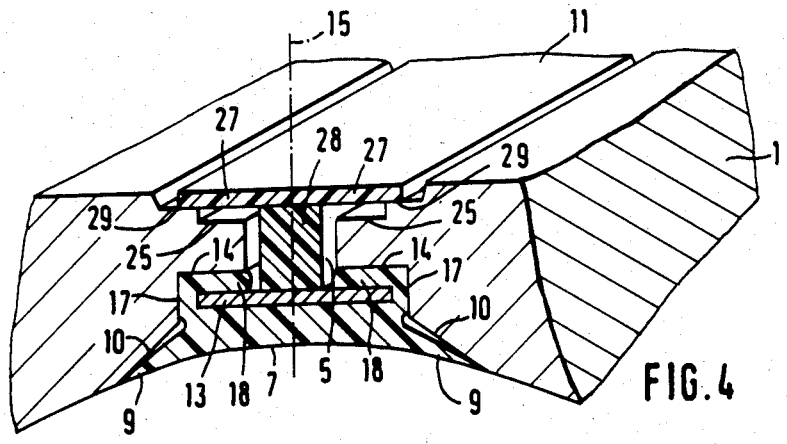
Figure 5:
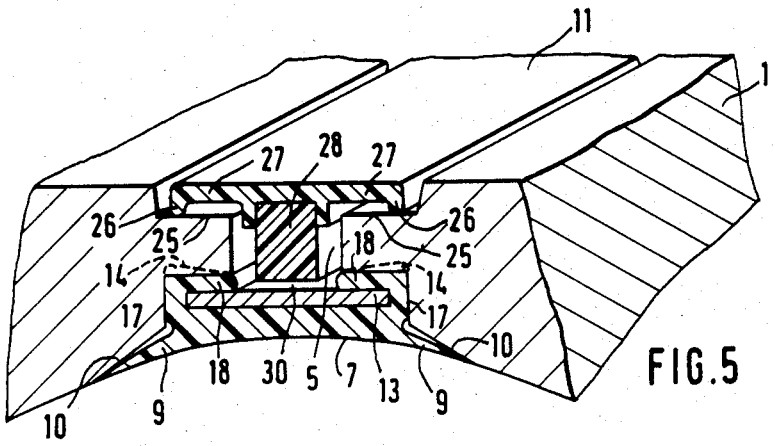

In the embodiment according to FIGS. 3 to 5 the sealing strip 7 is magnetically secured. For this purpose the stiffening strip 13 consists of a thin ferritic steel strip while on the cover strip 11 a fastening strip 28, at least permanently magnetic in places, is disposed extending in the axial direction of the cylinder into the elongated axial slit 5 and the magnetic closing circuit of which runs via the ferromagnetic stiffening strip 13. The magnetic fastening strip 28 can have, on the side oriented towards the stiffening strip 13, alternating magnetic poles of opposite polarity, however, it can also be made of a flexible plastic material in which finely dispersed permanently magnetic particles are embedded, such as is known in connection with flexible door sealing strips for refrigerators and the like.

In the embodiments in accordance with FIGS. 3, 4 the dimensions of the cooperating elements are selected such that with the sealing strip 7 abutting on the wall of the cylinder structure the stiffening variations 13 in general immediately abuts against the face of the magnetic fastening strip 28 oriented towards it without an air gap. To achieve the required radial flexibility of the cover strip 11, the slits 25 are respectively provided with a longitudinal shoulder 29 on which the cover strip 11 extends strip-like near the edge, so that the unsupported region 27 again follows on both sides. Alternatively, tip-stretched support beads 26 or like elements can of course be used as shown in FIG. 5.

In the embodiment according to FIG. 5 the arrangement is such that an air gap 30 is formed in the sealing state between the ferromagnetic stiffening strip 13 and the surface of the fastening strip 28 oriented toward it. This air gap 30 permits an even greater variation compensation in a radial direction between the sealing strip 7 and the cover strip 11.

The stiffening strip 13 can be openly disposed directly on the upper surface facing away from the piston of the sealing strip 7 in such a way that it directly abuts against the engagement surfaces 14 of the cylinder structure 1. It can, however, also be advantageous if the stiffening strip 13 is supported against the engagement surfaces 14 by means of interposed parts of the sealing strip 7, so that an elastic support of the stiffening strip 13 and thereby an even greater spread of the allowable manufacturing variations results. In a practical design the stiffening strip 13 can be embedded, at least over a portion of its width, in the sealing strip 7.

Simple manufacturing conditions for the cylinder structure 1 and the sealing strip 7 result if the generally flat engagement surfaces 14 are disposed at right angles or at an acute angle to the central plane of the cylindrical structure 1, containing the axis of the cylindrical structure. The engagement surfaces 14 then can have an inner relief recess 16, starting from the elongated axial slit 5, which assures a certain radial mobility under the influence of the pressure medium of the parts of the stiffening strip 13 situated above this inner relief recess 16. By this means it is also or additionally possible to counteract the already mentioned arching of the stiffening strip 13 into the elongated axial slit 5 under the influence of the pressure medium.

In a preferred embodiment the stiffening strip 13 has, at least on its side oriented toward the elongated axial slit 5, a generally flat surface which at least approximately extends at right angles to the central plane 15 of the elongated axial slit 5. In order to prevent that, because of manufacturing variations etc., the sealing strip 7 is laterally displaced towards the elongated axial slit 5 and thereby the seal is endangered, it is practical if the sealing strip 5 and/or the stiffening strip 13 are laterally guided via guide surfaces 17 provided in the wall of the cylindrical structure 1 while restricted in their radial movement. Radial mobility is required in order to be able to lift the sealing strip 7 from the elongated axial slit 5 in the region of the force transfer element 6 of the piston 4. Limitation of the mobility is achieved by the fact that the stiffening strip 13 is supported in the already discussed manner on the engagement surfaces 14.

As connecting elements the cover strip 11 or the sealing strip 7 could have at least one ridge 22, extending in the longitudinal direction of the cylinder, extending into the elongated axial slit 5 and profiled in cross section, and the sealing strip 7 or the cover strip 11 could have two flanges 23 delimiting a slit 25, between which the ridge 22 is clamped elastically. Very simple manufacturing conditions result when the stiffening strip 13 is surrounded by the sealing strip 7 on the side oriented towards the elongated axial slit 5, while leaving a strip-like center area free, which extends in the longitudinal direction of the strip, where the flanges are formed by the sealing strip material delimiting the center area which is, if required, bent up or arched up in the direction towards the elongated axial slit 7.

Since in these embodiments the sealing strip 5 and the cover strip 11 are mechanically held against each other in a form-locking or friction-locking manner by means of the cooperating connecting elements, the thin stiffening strip 13 can per se consist of any material having the required strength and flexibility, for example a suitable plastic material. It is also conceivable to form the stiffening strip 13 by means of an integrated zone of increased stiffness and strength of the sealing strip 7 which, outside of this zone, is elastomeric or considerably more flexible. In another embodiment the thin stiffening strip 13, however, can also be made of steel since steel, and especially spring steel, has especially advantageous properties for this purpose. If the thin stiffening strip 13 consists of ferritic steel, the arrangement can be such that a fastening strip 28, at least partially permanently magnetic and extending in the longitudinal direction of the cylinder, is disposed on the cover strip 11 as a connecting element and extends into the elongated axial slit 5, the magnetic closing circuit of which runs via the stiffening strip 13. By this means the sealing strip 7 is held by magnetic force on the cover strip 11 and no additional measures need be taken in connection with the cylinder structure 1 itself. Since the closing circuits of the magnetic force lines run exclusively within the elongated axial slit 5, the cylinder structure 1 can be made of any desired material and therefore also of ferritic steel or the like.

The magnetic fastening strip 28 can be made either from, for example, flexible plastic material containing finely dispersed permanently magnetic particles, such as is usual in strip-like form for example as door seals for refrigerators and the like, or from a flexible strip of plastic material into which permanently magnetic parts have been embedded at intervals. The surface of the fastening strip 28 oriented towards the stiffening strip 13 can, with an effective sealing strip 13 and cover strip 11, run at a distance from the stiffening strip 13 while forming an air gap 30 which compensates for possible manufacturing variations.

To make this variation balance even more effective, the cover strip 11 can be supported on the outside of the cylinder structure 1 or at the bottom of a longitudinal slit 25 disposed on the outside thereof next to the elongated axial slit 5 at a lateral distance from the edge of the elongated axial slit 5, where unsupported regions 27 of the cover strip 11 lie between the support places and the edge of the elongated axial slit 5. By this embodiment it becomes possible for the cover strip 11 to attain a slight hysteresis when the connecting elements interact with the cover strip 11 and thereby to compensate for existing manufacturing and dimensional variations. If the cover strip 11 has a shape in its unsupported regions 27 which assists its elastic properties, for example in the form of ribs, tenuous zones, etc., this also works in that direction.

Finally it is advantageous if the cover strip 11 has, adjacent to the stiffening strip 13, profiled sealing lips 9 extending laterally, which cooperate with the sealing surfaces 10 and thereby assure an especially effective seal.

I claim:

1. Axially slit pressure cylinder having a cylinder structure (1) formed with an elongated axial slit (5) therein;

a piston (4) guided in the pressure cylinder structure;

an externally projecting force transfer element (6) connected to the piston and extending through said slit;

a flexible sealing strip (7) including sealing lips thereon (9) guided through a first opening region formed in the force transfer element (6) to seal the interior of the cylinder against the outside;

sealing surfaces (10) formed in the interior of the cylinder and positioned in engagement by the sealing lips (9) of the sealing strips;

a flexible cover strip (11) located outside of the cylinder and guided through a second opening region formed in the force transfer element;

releaseable connection means (22, 23; 28) connecting the sealing strip (7) and the cover strip (11) to hold the sealing strip and the cover strip together while permitting separation upon passing through the force transfer element, and reconnection beyond the force transfer element, and comprising, a stiffening strip means (13) located in the interior of the cylinder and joined to the flexible sealing strip (7), said stiffening strip means having a higher strength and stiffness than the flexible sealing strip;

engagement surfaces (14) located close to the sealing surfaces (10) and positioned adjacent the sides of the slit (5) in the interior cylinder, forming abutment and support surfaces for the stiffening means and being positioned in at least approximate radial alignment with said stiffening strip means, and wherein the engagement surfaces (14) are formed with an inner relief recess (16), remote from the longitudinal slit (5).

2. The cylinder of claim 1, wherein the stiffening strip means extends in at least approximate radial alignment with the respective engagement surfaces (14) by a distance which is at least as great as the widths of the longitudinal slit (5).

3. The cylinder of claim 1, wherein the inner relief recesses (16) extend in a direction away from a central axis of the cylinder, to thereby flare the engagement surfaces (14) outwardly away from said central axis.

4. The cylinder of claim 1 wherein the stiffening strip means comprises a zone of sealing strip material which is stiffer and has a higher strength than the sealing strip outside of said zone, said zone of stiffer and stronger material extending, in cross section, transversely of said sealing strip up to and beyond the engagement surfaces (14) to provide for load transmission against said engagement surfaces, said zone terminating short of the sealing lips (9) to provide for tight flexible sealing engagement of said sealing lips with the sealing surfaces (10).

5. The cylinder of claim 1 wherein the stiffening strip means (13) comprises a strip of material which is stiffer and stronger than said flexible sealing strip, and extending, transversely, beyond said engagement surfaces (14).

6. The cylinder of claim 1 wherein the stiffening strip means extends in at least approximate radial alignment with the engagement surfaces by a distance which is at least equal to the width of the longitudinal slit (5).

7. The cylinder of claim 1 wherein (FIGS. 2, 4, 5) a portion of the flexible sealing strip (7) is interposed between the stiffening means (13) and said engagement surfaces.

8. The cylinder of claim 1 wherein (FIGS. 4, 5) the stiffening strip means is embedded at least over a portion of its width within the sealing strip (7).

9. The cylinder of claim 1 wherein the engagement surfaces (14) are at least essentially flat and extend at a right, or an acute angle with respect to a central plane (15) coincident with the axis of the cylinder structure.

10. The cylinder of claim 1 wherein the stiffening strip means is formed with an essentially flat surface on the side facing the longitudinal slit, which flat surface extends approximately perpendicularly to a central plane passing through the center of the longitudinal slit (5) and the central axis of the cylinder structure.

11. The cylinder of claim 1 wherein the cylinder structure is formed with guide surfaces (17) to provide for lateral and radially limited movement and guidance of at least one of: the flexible sealing strip (7) and said stiffening strip means (13).

12. The cylinder of claim 1 wherein the sealing lips (9) extend laterally of the stiffening strip means (13) from the sealing strip (7) and are dimensioned and shaped to match at least approximately said sealing surfaces (10) formed in the interior of the cylinder structure.

13. The cylinder of claim 1 wherein said releaseable connection means comprises a strip or rib structure (22) extending from one (11) of said strips (7, 11) and projecting within the longitudinal slit;

and wherein the other one (7) of said strips is formed with side flanges (23) defining a longitudinal groove (24) therebetween, said rib fitting within said groove within an interengaging snap-end projection-and-recess fit for resilient retention of the rib (22) within said groove (24) while permitting, resiliently, separation of said strips.

14. The cylinder of claim 13 wherein the stiffening strip means (13) comprises an insert strip of said material having higher strength and stiffness than the flexible sealing strip (13), said insert strip being covered by material of said flexible sealing (7) at the edge portions thereof and leaving free a central zone;

and wherein the flanges (23) are formed by bent-outwardly—with respect to a center line of the cylindrical structure—edge regions of the material of the flexible sealing strip.

15. The cylinder of claim 1 wherein said stiffening strip means (13) comprises an insert strip of a material having said higher strength and stiffness than the flexible sealing strip (7)

said insert strip being formed of a thin strip element of plastic material.

16. The cylinder of claim 1 wherein said stiffening strip means (13) comprises an insert strip of a material having said higher strength and stiffness than the flexible sealing strip (7)

said insert strip being formed of a thin strip element of steel.

17. The cylinder of claim 1 wherein said stiffening strip means (13) comprises an insert strip of a material having said higher strength and stiffness than flexible sealing strip (7)

said insert strip being formed of a thin strip element of magnetizible steel.

18. The cylinder of claim 17 wherein (FIGS. 3, 4, 5) said releaseable connection means comprises permanent magnet means (28) secured to the flexible cover strip (11) and extending into said slit (25), said permanent magnet means magnetically interacting with said steel magnet strip which forms at least part of a magnetic circuit.

19. The cylinder of claim 18 wherein the magnetic means (28) comprise permanent magnet poles of alternately different polarity facing the insert strip (13).

20. The cylinder of claim 19 wherein said flexible cover strip (11) comprises a flexible plastic material, and said magnetic means include permanent magnet elements secured to said flexible cover strip in longitudinal staggered position.

21. The cylinder of claim 17 wherein the magnetic means are spaced from the insert strip (13) by an air gap (30).

22. The cylinder of claim 1 wherein the surface of the cylinder structure (1) adjacent said slit is formed with a shallow groove (25) extending longitudinally parallel to said slit based laterally therefrom;

and wherein the cover strip (11) and said groove are respectively shaped and dimensioned to provide engagement surfaces between the cover strip and the surface of said groove and an unsupported region (27) circumferentially inwardly of said engagement surfaces and positioned adjacent said slit (5).

23. The cylinder of claim 22 wherein said engagement surfaces are formed on said cover strip (11) and include longitudinally, radially inwardly directed beads (26) for engagement with the bottom of said groove while leaving said unsupported region adjacent said bead.

24. The cylinder of claim 22 wherein the unsupported region (27) of the cover strip is dimensioned and shaped to provide a predetermined, resiliently changeable configuration as determined by the resiliency characteristics of the material of the cover strip.

* * * * *